United States Patent [19]

Hom

[11] Patent Number: 4,463,326

[45] Date of Patent: Jul. 31, 1984

[54] PLANAR N-WAY COMBINER/DIVIDER FOR MICROWAVE CIRCUITS

[75] Inventor: Harvey K. Hom, Santa Monica, Calif.

[73] Assignee: International Telephone and Telegraph Corporation, New York, N.Y.

[21] Appl. No.: 326,686

[22] Filed: Dec. 2, 1981

Related U.S. Application Data

[63] Continuation-in-part of Ser. No. 220,294, Dec. 29, 1980, abandoned.

[51] Int. Cl.[3] ..... H01P 5/12

[52] U.S. Cl. ..... 333/128; 333/33

[58] Field of Search ..... 333/127, 128, 136; 330/286, 287

[56] References Cited

U.S. PATENT DOCUMENTS 4,254,386 3/1981 Nemit et al. ..... 333/128

OTHER PUBLICATIONS

Maekawa et al., *N-Way Planar Hybrid Power Dividers by New Synthesis Method,* The Trans. of the IECE of Japan, vol. E60, No. 9, Sep. 1977, pp. 491, 492.

*Primary Examiner*—Paul L. Gensler

*Attorney, Agent, or Firm*—T. E. Kristofferson; A. D. Stolzy

[57] ABSTRACT

A microwave combiner/divider circuit instrumented in stripline medium and therefore planar in form. Circuit traces are produced by etching of a standard microwave printed circuit board having a conductive ground plane or base plate and a layer of low-loss insulation over which a copper layer is provided. A common signal port feeds a division point through a capacitive stub and a two-stage, ring-type impedance matching circuit. The multiple circuit traces emanating from the division point are arranged so that N individual branch ports are connected thereto. The stripline circuitry between the division point and the branch ports provide compensation for phase reversal. Resistors for branch port isolation connected within the stripline circuitry such that for equal loads or equal power sources connected to the branch ports (divider or combiner applications, respectively) zero currents flow in these resistors and they are therefore not required to provide a large power dissipating capability.

9 Claims, 2 Drawing Figures

PLANAR N-WAY COMBINER/DIVIDER FOR MICROWAVE CIRCUITS

CROSS-REFERENCE TO RELATED APPLICATION

This application is a continuation-in-part of U.S. patent application Ser. No. 220,294, filed Dec. 29, 1980, now abandoned.

BACKGROUND OF THE INVENTION

1. Field of the Invention

The invention relates generally to radio frequency combiner/divider devices.

2. Description of the Prior Art

There are many applications for reciprocal devices capable of combining radio frequency signals to achieve a higher power level or for dividing a given RF signal into equal parts and developing these divided signals at a corresponding plurality of branch ports. The latter may include signal division into a number of channels for separate signal processing.

Recently, solid state microwave amplifier modules capable of operation in the microwave regions have appeared in the art. These modules provide higher reliability but, compared to vacuum tube higher power amplifiers, are sharply limited in their power handling capability. Accordingly, power combining circuits are necessary in order that the inherent reliability of these solid state devices may be exploited while at the same time providing suitably high levels of transmittable power. It is also important that the failure of one or a few of the individual power generating modules not deteriorate the overall output power level available by significantly more than the contributions of the failed individual module or modules.

Prior art combiner/divider circuits exist for performing the basic power dividing and combining function aforementioned. For example, one relatively early version of such a device is described in a paper by E. J. Wilkinson entitled "N-Way Hybrid Power Divider" (IRE Transactions on Microwave Theory and Techniques, Volume MTT-8, pages 116–118 of January, 1960). That device has been identified in the art as the Wilkinson combiner/divider. Several disadvantages accrue to the Wilkinson combiner/divider, one of these being the fact that a star of balancing/isolation resistors is required and is difficult to realize in practice, particularly for a large number of output (branch) ports. The Wilkinson circuit causes the dissipation of considerable power in this resistor star (in the imbalanced mode), but the chip resistors usually employed for the purpose limit the power handling capability of the Wilkinson combiner/divider to less than 100 watts CW because adequate heat sinking of the resistors is simply not practical, especially at high frequencies.

Another form of power combiner/divider operable at higher power levels than the Wilkinson device is commonly referred to as the Gysel combiner/divider. That device was described in the IEEE-MTT-5 International Symposium Digest, page 116 (1975). The Gysel device has as its main advantage the capability of employing external isolation resistors which may be individually capable of higher power handling. Accordingly, the overall device is capable of higher power operation. Still further, the Gysel device provides for monitoring capability for imbalances at the output ports, but an important disadvantage of the Gysel combiner is the circuit construction restriction. Existing techniques use either overlapping two-layer stripline with inter-layer RF connections or a cylindrical cavity configuration. Either approach presents difficult mechanical problems especially at frequencies above 1.0 GHz.

One problem which occurs in so-called unattended or minimally attended radar transmitters using plural RF power generator modules and a combiner such as the Gysel device, is the effect of failure of an individual solid state module on the overall operation of the device. Not only is the power contribution of the failed module lost, but substantial loading of the outputs of the remaining operable modules results.

Neither the Wilkinson nor the Gysel combiner/divider configurations provide for continued operation without unacceptable overall losses when one or more of the transmitting modules becomes inoperative.

Another U.S. patent application which deals with the failed module problem in another way is U.S. Pat. No. 4,225,866, issued Sept. 30, 1980, and entitled "Automatic Failure-Resistant Radar Transmitter." That patent is likewise assigned to the present assignee. The system therein described allows for derated operation of the low power modules whose outputs are being combined for increased reliability and automatic increase of average power per module when a module failure occurs. The loading of the active modules inherent in that application is accepted as inevitable; however, an arrangement which would preclude those losses is much to be preferred.

The manner in which the present invention deals with the prior art disadvantages to produce a novel and advantageous combiner/divider structure will be understood as this description proceeds.

SUMMARY OF THE INVENTION

It may be said to be the general object of the invention to provide a low-cost microwave signal combiner/divider which is instrumentable in planar microstrip form.

The combiner/divider configuration according to the invention is relatively immune to the deleterious effects of failure of an individual microwave power generator feeding one of the branch ports when the device is used as a power combiner. The reason for this immunity will become clear as this description proceeds.

The invention may be characterized as a bi-phased planar N-way combiner (or divider). The apparatus described includes a common port at which the combined energy is available if the device is being used as a power combiner. From this common port, a ring type impedance matching arrangement is included connected to a division point with N microstrip traces radiating therefrom, where N is the number of branch ports provided. Accordingly, the division ratio when the device is used as a divider is 1/N from the common port to each branch port. From the common point, after impedance transformation, the layout of the microstrip traces is such that alternate branch ports are fed through a path one half wavelength longer than that of the remaining branch port connections. The microstrip circuit traces are so arranged that the desired circuit paths between the division point associated with the common port and each of the branch ports compensates for the aforementioned phase differentials at the branch ports by virtue of corresponding circuit path length differentials. The isolation resistors are grounded by means of a conventional microstrip quarter-wave stub on one end and points along the circuit traces leading from alternate branch ports where the path lengths to the points of resistor connection produce a zero RF potential and therefore zero current in the resistors. That condition, of course, pertains to the completely balanced operation, i.e., for the power combiner mode of operation, equal amplitude and in-phase excitation signals at each branch port. For the condition of unequal power level or other phase relationships, current will flow in the isolation resistors; however, the power dissipation is markedly lower in the isolation resistors than that resulting in the comparable isolation resistors in prior art combiner/divider devices. Accordingly, it will be seen that the device of the present invention, although entirely reciprocal, presents its greatest advantage when used as a power combiner, i.e., for the situation in which a plurality of solid state relatively low powered RF sources are to be combined to provide a higher level of power at the common port. Thus, the prior art limitation respecting power dissipation in the isolation resistors is greatly relieved through the use of the circuit of the present invention. Still further, the device of the invention is substantially unaffected by the failure of the individual power generating modules, except of course for the loss of power contribution from such failed module or modules.

A typical embodiment of the invention in microstrip form is hereinafter described in detail.

DETAILED DESCRIPTION OF THE PREFERRED EMBODIMENT

Figure 1:
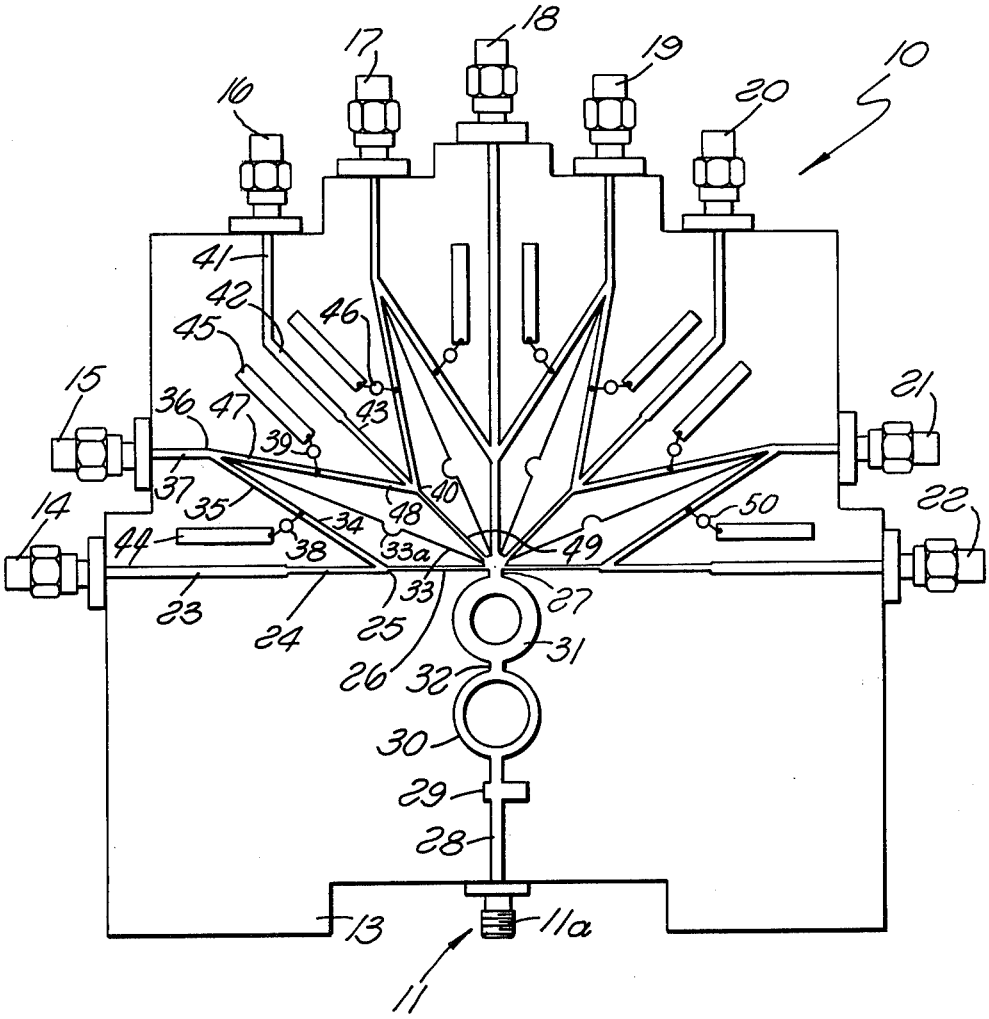
FIG. 1 is a plan layout of a microstripped instrumentation of the invention.

Referring now to the drawing, a microstrip circuit according to the invention is depicted generally at 10. The method of construction of the circuit is entirely conventional and according to well-known microstrip instrumentation techniques. As viewed in plan at FIG. 1, the various conductive circuit traces are isolated from a conductive baseplate 12 (see FIG. 2) by a layer of insulation 13. This insulation layer 13 is of a quality providing low-loss at microwave frequencies. In manufacture, the material is commercially available applied over a conductive base 12 of aluminum or similar material. A conductive layer, preferably of copper or other high conductivity metal, is applied uniformly over the insulation (dielectric) layer 13 and the desired circuit traces as depicted in FIG. 1 are produced by photo-etching or a similar process which removes all of the thin conductive material overlapping the dielectric 13 except that shown in FIG. 1. As aforementioned, this process for producing the circuit traces according to the invention or any other microstrip circuit is well-known in this art.

The circuit as depicted in the plan view of FIG. 1 is composed of microstrip conductive traces from the residual conductive material after photo-etching. The common port 11 is a coaxial connector having impedance characteristics consistent with the microstrip circuitry connected thereto. The coaxial connector at port 11 was, for example, a 50 ohm type in a representative implementation of the invention. The outer conductor portion 11*a* is connected to a flange 11*c* and an inner conductor 11*b* connects directly to the circuit trace 28. By means of the flange 11*c*, the outer shell of the coaxial connector is conductively fixed to the conductive substrate 12. at This port interface arrangement is also typical of the nine branch ports 14, 15, 16, 17, 18, 19, 20, 21 and 22 illustrated in FIG. 1. That is, the inner conductors of those branch port coaxial connectors connect directly to corresponding circuit traces such as the inner conductor of branch port connector 14 being connected to circuit trace 23, that of connector 15 being connected to circuit trace 37. Still further, circuit trace 41 is to be understood to connect directly to the center conductor of the coaxial branch port connector 16 and so on through the other branch port connectors 17–22.

The choice of nine branch ports illustrated in FIG. 1 is by no means a required format for the invention, a larger or smaller odd number of branch ports being possible. The modification of the circuit traces of FIG. 1 to accommodate more or fewer branch ports will be obvious to those of skill in this art once the typical embodiment depicted in FIGS. 1 and 2 is described and understood.

Figure 2:
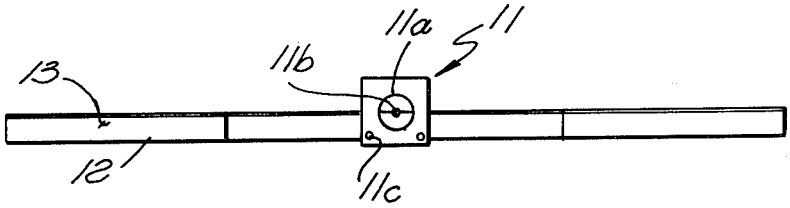
FIG. 2 is an edge view of the device of FIG. 1.

It will be understood that the coaxial connectors for the branch ports and the common port would, in a repeatably produced version, incorporate coaxial connectors better suited mechanically; however, those illustrated in FIGS. 1 and 2 were employed in a successful experimental version of the invention.

Although the device according to the invention is fully reciprocal, i.e., it can operate as a combiner or divider, it will be assumed for the sake of description that it is being operated as a combiner. In that mode, the multiple power sources (nine in number according to the FIG. 1 illustration) are discretely connected to corresponding ones of the branch ports 14–22. The combined powers applied at these branch ports, less some unavoidable minimal circuit loss, then appears at the common port 11. The main collection or common circuit point is identified as 27 and is inherently a low impedance point due to the parallel connection of the many branch circuit traces connected thereto.

A two stage impedance transformer is provided by rings 30 and 31 connected at point 32. Since the point 27 is as aforementioned, a low impedance point, the combination of rings 31 and 30 serve to step up the impedance to that of trace 28 which is in turn connected to the center conductor 11*b* of common port coaxial connector 11. Element 29 is a capacitive stub for the counteraction of inductive effects between common port 11 and the aforementioned point 27. This impedance transformation arrangement including the capacitive stub 29 will be recognized by those of skill in this art as a common expedient in the implementation of microstrip circuitry. Power extant at each of the branch ports 14–22 finally combine at point 27 after intermediate combinations are effected for example at points 25 and 40. It is considered only necessary to describe the circuitry between the first few branch ports, for example, ports 14–17 as they contribute to the power extant at point 27, since the remainder of the circuit is essentially identical.

Starting with branch port 14, energy applied thereto reaches point 25 where it is combined with energy applied at branch port 15. From 14 the path includes a half-wave section 23 and a quarter-wave section 24, and from 15 the path includes three separate quarter-wave sections 37, 35 and 34. Accordingly, these signals are in the same phase and are additively combined at point 25. Similarly, energy applied at branch port 16 reaches point 40 where it is combined with energy applied at branch port 15. From 15 the path includes a quarter-wave section 37 and a half-wave section 48, and from 16 the path includes three quarter-wave sections 41, 42 and 43. Accordingly, these signals are also in the same phase and are additively combined at point 40. Accordingly, it will be realized that at points 25 and 40 and the like points (three in number) illustrated in FIG. 1, all signals are in the same phase. From each of these aforementioned combination points such as 25 and 40, another quarter-wave section such as 26 and its counterparts conveys the equiphased energy to point 27 at which it is further combined additively.

It is of particular importance to note that the isolation resistors, typically 38, 39 and 46, etc., are connected from the corresponding points on the circuit traces which provide antiphase potentials at their points of connection. That is, in the case of port 14, half-wave trace 23 and the two quarter-wave traces 24 and 34 represent a full wave of transmission line from port 14 to isolation resistor 38. From adjacent branch port 15, however, only quarter-wave traces 37 and 35 must be traversed to reach resistor 38 from branch port 15. Consequently, the contributions from branch ports 14 and 15 at the point of connection of resistor 38 are 180° out of phase and, assuming precisely in-phase input signals into branch ports 14 and 15 at the same power level, no current is thereby caused to flow in isolation resistor 38 although the energies at these two branch ports 14 and 15 are effectively combined at point 27.

Similarly, a path length from branch port 16 comprises four quarter-wave length circuit trace legs 41, 42, 43 and 49 to reach point 27, essentially matching the path length from branch port 15 by quarter-wave trace legs 37, 47, 48 and 49 to reach point 27. However, isolation resistor 39 is connected one half-wave length from branch port 15, but one full-wave length by trace legs 41, 42, 43 and 48 between branch port 16 and resistor 39. This circuit logic applies in respect to branch port 17 and resistor 46 and so on throughout the circuit layout of FIG. 1 up to and including the last illustrated isolation resistor 50.

To provide an effective ground point for the opposite sides of the resistors such as 38, 39, 46 and 50, quarter-wave stubs, typically 44 and 45 connected to resistors 38 and 39, respectively, are employed. It is well-known in the art that such a quarter-wave stub presents a short circuit at its input or point of resistor connection and in this case the short circuit is effectively to ground by virtue of the microstrip instrumentation depicted.

A "diagonal" higher impedance circuit trace 33 of three-quarter wavelength provides an impedance matching function. The half loop 33*a* compensates for the fact that the circuit trace geometry would not permit a straight line trace between points 36 and 27 of three-quarter wavelength precisely, hence loop 33*a* is provided so that the trace is effectively lengthened to the required three-quarter wavelengths.

For a typical instrumentation according to the invention as illustrated in FIG. 1, following are typical circuit trace leg design impedances, along with corresponding values of isolation resistors.

Circuit Impedance Table

| | Z |
|---|---|
| Ports | |
| 11, 14-22 | 50 |
| Resistors | |

-continued

Circuit Impedance Table

| | Z |
|---|---|
| 38, 50 | 75 |
| 39, 46, etc. (typical) | 50 |
| Circuit Traces | |
| 26, 33, etc. (typical) | 113 |
| 23, 28, 41, etc. (typical) | 50 |
| 24, 37, 42, etc. (typical) | 66 |
| 35, 47, etc. (typical) | 87 |
| 31 | 44 |
| 30 | 76 |

It will be realized that the instrumentation of the invention, while convenient in stripline medium is not basically so limited. Although less attractive from a cost and size point of view, coaxial line or other transmission line media could be compounded to produce the desired effect.

Other modifications and variations will occur to those of skill in this art once this invention is fully appreciated. Accordingly, it is not intended that the drawings nor this description should be considered as limiting the scope of the invention.

What is claimed is:

1. A radio frequency combiner/divider device comprising:

a common port and a plurality of branch ports, said device being operative as a power combiner for discrete sources distributed among said branch ports to provide higher power at said common port and said device providing division among said branch ports of power applied to said common port when said device is employed as a divider;

first means comprising a path having a three-quarter wavelength transmission line segment from each port of a first fraction of said branch ports to a corresponding one of a like number of first common points within said device;

second means comprising a quarter wavelength transmission line segment from each port of a second fraction of said branch ports to a corresponding one of a like number of second common points within said device;

third means comprising a plurality of pairs of branch transmission line segments each of one-half wavelength, the lines of one of said branch line pairs being connected at one end from a corresponding one of said second common points and the other ends of each of said branch lines being connected discretely to a predetermined one of said first common points;

fourth means comprising an isolation resistor connected between an electrical ground within said device and the midpoint of each of said third means branch transmission line segments, the number of said resistors thereby being equal to the number of said branch ports;

fifth means comprising a plurality of quarter wavelength transmission line segments, one corresponding and connected between each of said first common points and a third common point, said wavelength corresponding to a predetermined microwave frequency region of operation of said combiner/divider; and sixth means connecting said third common point to said common port.

2. A device according to claim 1 further including seventh means comprising a plurality of three-quarter wavelength transmission line segments connected one from each of said second common points to said third common point, said seventh means transmission line segments providing an impedance matching function and being of a higher impedance than the impedance extant at said third common point and at said second common points.

3. Apparatus according to claim 1 in which said fourth means electrical grounds are provided by a corresponding plurality of quarter-wave transmission line segments forming open end quarter-wave stubs connected at one end to the corresponding one of said resistors, said stubs acting as short circuits to ground at the points of connection of said resistors.

4. Apparatus according to claim 1 in which said device is implemented in microstrip medium, said transmission line segments all being in the form of microstrip conductive traces over a conductive ground plane with a dielectric layer therebetween.

5. Apparatus according to claim 3 in which said device is implemented in microstrip medium, said transmission line segments all being in the form of microstrip conductive traces over a conductive ground plane with a dielectric layer therebetween.

6. A device according to claim 5 further including seventh means comprising a plurality of three-quarter wavelength transmission line segments connected one from each of said second common points to said third common point, said seventh means transmission line segments providing an impedance matching function and being of a higher impedance than the impedances extant at said third common point and at said second common points.

7. Apparatus according to claim 1 in which said ports include coaxial connections and said sixth means comprises an impedance matching network for matching its coaxial connection to the inherently low impedance extant at said third common point.

8. Apparatus according to claim 4 in which said sixth means comprises a two-stage, ring-type microstrip impedance matching circuit, whereby the circuit impedance at said common port is matched to the inherently lower impedance at said third common point.

9. A device according to claim 8 further including seventh means comprising a plurality of three-quarter wavelength transmission line segments connected one from each of said second common points to said third common point, said seventh means transmission line segments providing an impedance matching function and being of a higher impedance than the impedances extant at said third common point and at said second common points.

* * * * *